US009819155B2

(12) United States Patent
Kersting et al.

(10) Patent No.: US 9,819,155 B2
(45) Date of Patent: Nov. 14, 2017

(54) SPARK PLUG

(71) Applicant: Robert Bosch GmbH, Stuttgart (DE)

(72) Inventors: Hermann Kersting, Ludwigsburg (DE); Jorge Diaz Alfonso, Fellbach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/768,791

(22) PCT Filed: Feb. 21, 2014

(86) PCT No.: PCT/EP2014/053451

§ 371 (c)(1),
(2) Date: Aug. 19, 2015

(87) PCT Pub. No.: WO2014/131705

PCT Pub. Date: Sep. 4, 2014

(65) Prior Publication Data

US 2016/0006220 A1 Jan. 7, 2016

(30) Foreign Application Priority Data

Mar. 1, 2013 (DE) ..... 10 2013 203 566

(51) Int. Cl.

| | |
|---|---|
| ***H01T 13/04*** | (2006.01) |
| ***H01T 13/34*** | (2006.01) |
| ***H01T 13/20*** | (2006.01) |

(52) U.S. Cl.

CPC ..... *H01T 13/34* (2013.01); *H01T 13/20* (2013.01)

(58) Field of Classification Search

CPC ..... H01T 13/34; H01T 13/20

See application file for complete search history.

(56) References Cited

U.S. PATENT DOCUMENTS

2005/0052107 A1* 3/2005 Klett ..... H01T 13/20 313/143
2005/0110381 A1 5/2005 Kanao

FOREIGN PATENT DOCUMENTS

| | | | |
|---|---|---|---|
| DE | 102004026253 | A1 | 1/2005 |
| DE | 10340043 | A1 | 3/2005 |
| DE | 10342912 | A1 | 4/2005 |
| DE | 102005034886 | A1 | 2/2006 |
| DE | 102009047055 | A1 | 5/2011 |
| DE | 102009055397 | A1 | 7/2011 |
| JP | S5115526 | U | 2/1976 |

(Continued)

OTHER PUBLICATIONS

International Search Report issued for PCT/EP2014/078987 dated Mar. 17, 2015.

(Continued)

*Primary Examiner* — Donald Raleigh
(74) *Attorney, Agent, or Firm* — Norton Rose Fulbright US LLP; Gerard Messina

(57) ABSTRACT

A spark plug includes a housing, an insulator inside the housing, a center electrode inside the insulator, and a connecting pin inside the insulator. At least one fillet is formed at a change of cross section at the housing, at the insulator, at the center electrode, and/or at the connecting pin. The fillet, viewed in cross section, includes a first leg and a second leg at an angle to the first leg. The length of the first leg is greater than the length of the second leg.

12 Claims, 3 Drawing Sheets

(56) References Cited

FOREIGN PATENT DOCUMENTS

| | | | |
|---|---|---|---|
| JP | H11345676 | A | 12/1999 |
| JP | 2003045609 | A | 2/2003 |
| JP | 2004-022450 | A | 1/2004 |
| JP | 2010232192 | A | 10/2010 |
| JP | 2010267425 | A | 11/2010 |
| JP | 4874415 | B1 | 2/2012 |
| WO | 2008123342 | A1 | 10/2008 |
| WO | 2009/097267 | A2 | 8/2009 |
| WO | 2012039090 | A1 | 3/2012 |

OTHER PUBLICATIONS

International Search Report for PCT/EP2014/053451 dated Apr. 25, 2014.

* cited by examiner

SPARK PLUG

FIELD OF THE INVENTION

The present invention relates to a spark plug for an internal combustion engine.

BACKGROUND

Many designs for spark plugs for internal combustion engines are known from the related art. The spark plugs are used in internal combustion engines for igniting a fuel mixture. The spark plugs have a plurality of transitions in the case of changes of cross section. These transitions are usually provided with fillets. Viewed in cross section, the fillets usually define a circular segment. The fillets are typical weak spots for the mechanical failure of a spark plug.

SUMMARY

According to an example embodiment of the present invention, the fillets at the changes of cross section of the individual components of the spark plug are designed according to the occurring load. This improves the mechanical and electromechanical strength and the resistance of the spark plug. Simultaneously, the spark plug can be manufactured simply and cost-effectively and can be used with low maintenance. According to an example embodiment of the present invention, at least one fillet on the spark plug is designed in such a way that, viewed in cross section, it is no longer consistent with a circular segment. According to an example embodiment of the present invention, the leg lengths of the fillet are designed differently and can thus be constructed according to the force effect on the fillet or on the cross section transition. These advantages are achieved by a spark plug according to the present invention, including a housing, an insulator inserted into the housing, a center electrode inserted into the insulator and a connecting pin inserted into the insulator. The insulator is used for the electrical insulation of the center electrode and the connecting pin from the housing. With the aid of the center electrode, an ignition spark is generated on one side of the spark plug facing the combustion chamber. The connecting pin is used for connecting a cable or a plug connector. In particular, a panat, which connects the connecting pin to the center electrode, is also located in the insulator. A ground electrode is preferably electrically conductively connected to the housing and is also positioned on the side of the spark plug facing the combustion chamber. Very diverse changes of cross section are located on the individual components of the spark plug, a fillet being formed at each of them. The housing and the insulator are hollow components which extend along a center axis of the spark plug. On these two components, in an example embodiment, the fillets are formed on the inside and also on the outside. According to the present invention, it is provided that the fillet, viewed in cross section, has a first leg length and a second leg length at an angle to the first leg length. If the fillet is viewed in cross section, the fillet transitions into a straight line at two transition points. The leg lengths are each measured from one transition point to the other transition point. Thereby, each leg length is measured in parallel to one of the straight lines. The first leg length is greater than the second leg length. The different design of the leg lengths makes it possible for the fillet to be designed according to the force effect. As a result, the fillet used according to the present invention is mechanically more stable than the conventional, circular fillet. In the context of the present invention, the term "fillet" describes a curve which is tangential to the legs and can have a general shape between its beginning and end. This general shape can, for example, be described by a hyperbola, ellipse, parabola, evolute, involute, Bézier curve, spline or the like. Preferably, the curve is tangentially continuous.

In a preferred example embodiment, the first leg length is at least 1.3 times, preferably at least 1.5 times, particularly preferably at least 2 times the second leg length. This makes it possible to respond to the force effect on one side of the fillet to an adequate degree.

It is preferably provided that the first leg length is situated perpendicularly to the greatest force acting on the fillet. In particular, the first leg length stands perpendicularly to the center axis of the spark plug.

The two leg lengths are preferably each defined between two transition points, the fillet transitioning into a straight line at the transition points. The two leg lengths are each measured in parallel to one of the two straight lines into which the fillet transitions.

The connecting pin preferably includes a pin shaft and a collar. The connecting pin rests on the insulator with the aid of the collar. The fillet is preferably formed at the transition from the collar to the pin shaft. The first leg length preferably extends in the direction of the collar, i.e., perpendicularly to the center axis of the spark plug. This results in a reduction of the maximum tensile stress and consequently a reduction of stress corrosion cracking.

The housing preferably includes a shaft on which a thread, a polygon and a shrink groove are formed. The thread is used for screwing the spark plug into an engine block. A tool for screwing in the spark plug can be fitted on the polygon. The fillet is preferably formed at the transition from the shaft to the thread, in particular the thread groove. The first leg length preferably extends perpendicularly to the center axis, making it possible to achieve a reduction of the maximum tensile stress at this fillet.

It is furthermore preferably provided that the fillet is formed at the transition of the shaft to the shrink groove and/or at the transition of the polygon to the shrink groove. The first leg length also preferably extends perpendicularly to the center axis at these fillets, so that a reduction of the maximum tensile stress is achieved.

The center electrode preferably includes a first seat at a change of cross section. This first seat rests on the insulator. This position of the insulator is referred to as center electrode seat.

The insulator per se preferably includes a second seat at a change of cross section. The insulator rests on the housing with the aid of this second seat. The corresponding location on the housing is referred to as insulator seat.

The insulator includes a housing seat at a change of cross section. A side of the housing facing away from the combustion chamber rests on this housing seat.

Preferably, the fillet is formed at the first seat and/or second seat and/or center electrode seat and/or insulator seat and/or housing seat. At these different seats, there are generally two fillets, which are constructed based on the design according to the present invention. At the first seat (at the center electrode), the fillet is used for reducing the maximum tensile stresses/flexural stresses and consequently for avoiding or reducing center electrode fractures. The housing seat of the insulator is formed as a collar, on which the housing rests. The use of the fillet at the transition from the head of the insulator to the collar reduces the maximum flexural stress and consequently significantly increases the head flexural strength of the insulator.

The fillet at the transition from the center electrode seat to the center electrode bore of the insulator reduces the maximum inner flexural stress on the insulator and simultaneously reduces the electrical field enhancement in interaction with the geometry change of the center electrode in the area of the first seat.

At the outer surface of the insulator, the insulator at the second seat transitions into a so-called foot cone. This foot cone is the end of the insulator facing the combustion chamber. The use of the fillet in this area at the center electrode, at the outside and inside of the insulator, and at the housing seat, makes it possible to observe a significant improvement with regard to failure based on high electromechanical loads in modern internal combustion engines having high combustion chamber pressures and ignition voltage requirements.

At the previously depicted cross section transitions of the spark plug, the fillet is preferably applied using the different leg lengths. However, this type of fillet may be used preferably at all cross section transitions of the spark plug.

One example embodiment of the present invention is explained in detail below with reference to the accompanying drawings.

DETAILED DESCRIPTION

Figure 1:
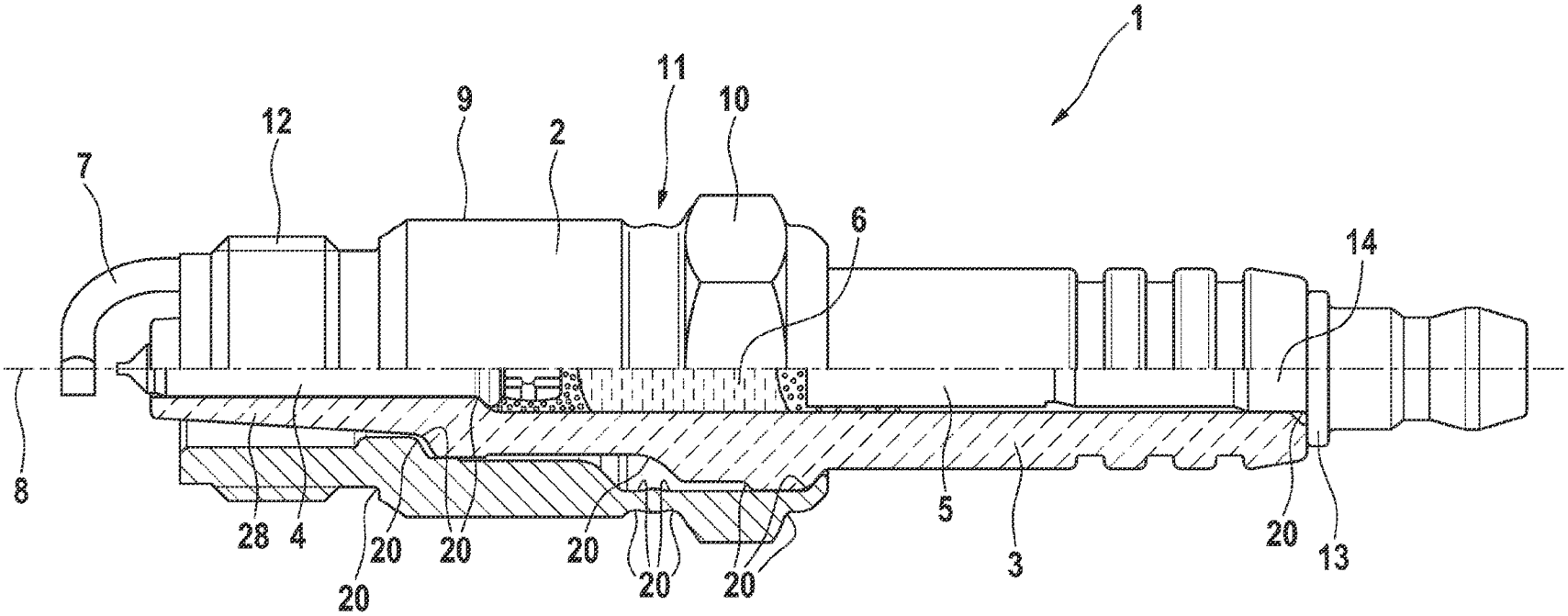
FIG. 1 shows a spark plug according to an example embodiment of the present invention.
Figure 2:
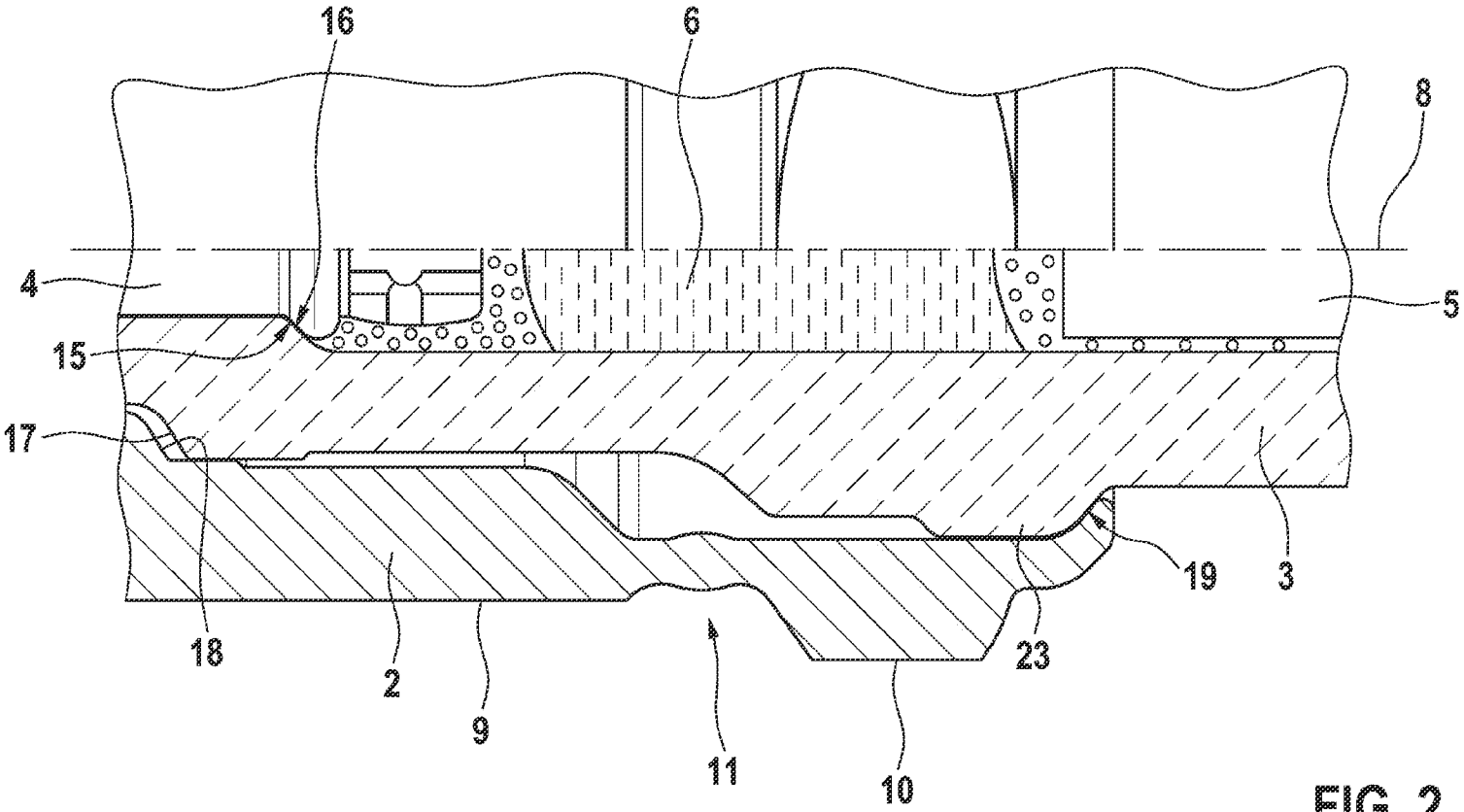
FIG. 2 shows a detail of FIG. 1.

FIG. 1 shows a spark plug 1 in a half-sectioned view. Spark plug 1 includes a housing 2. An insulator 3 is inserted into housing 2. Housing 2 and insulator 3 are each internally hollow. A center electrode 4 is inserted into insulator 3. Furthermore, a connecting pin 5 is inserted into insulator 3. A panat 6 in insulator 3 is located between center electrode 4 and connecting pin 5. Panat 6 electrically conductively connects center electrode 4 to connecting pin 5. A ground electrode 7 is electrically conductively connected to housing 2 on the side facing the combustion chamber. The appropriate ignition spark is generated between ground electrode 7 and center electrode 4. Spark plug 1 extends around a center axis 8.

Housing 2 includes a shaft 9. A polygon 10, a shrink groove 11 and thread 12 are formed on the shaft 9. Thread 12 is used for screwing spark plug 1 into an internal combustion engine.

Connecting pin 5 includes a pin shaft 14, which extends along center axis 8, and a collar 13. Connecting pin 5 rests on insulator 3 with the aid of collar 13.

Insulator 3 has an insulator collar 23 and a foot cone 28.

Insulator 3 includes a center electrode seat 16 at the transition to foot cone 28. Center electrode 4 includes a first seat 15 that rests on the center electrode seat 16. Housing 2 includes an insulator seat 18 at its inside. A second seat 17, formed at insulator 3, rests on insulator seat 18. Depending on the temperature of spark plug 1, a gap may be present between second seat 17 and insulator seat 18. Furthermore, insulator 3 includes a housing seat 19 at its insulator collar 23. Housing 2 rests on the housing seat 19.

Fillets 20 having an appropriate geometry are provided in particular at the described seats, namely first seat 15, center electrode seat 16, second seat 17, insulator seat 18 and housing seat 19.

Figure 3:
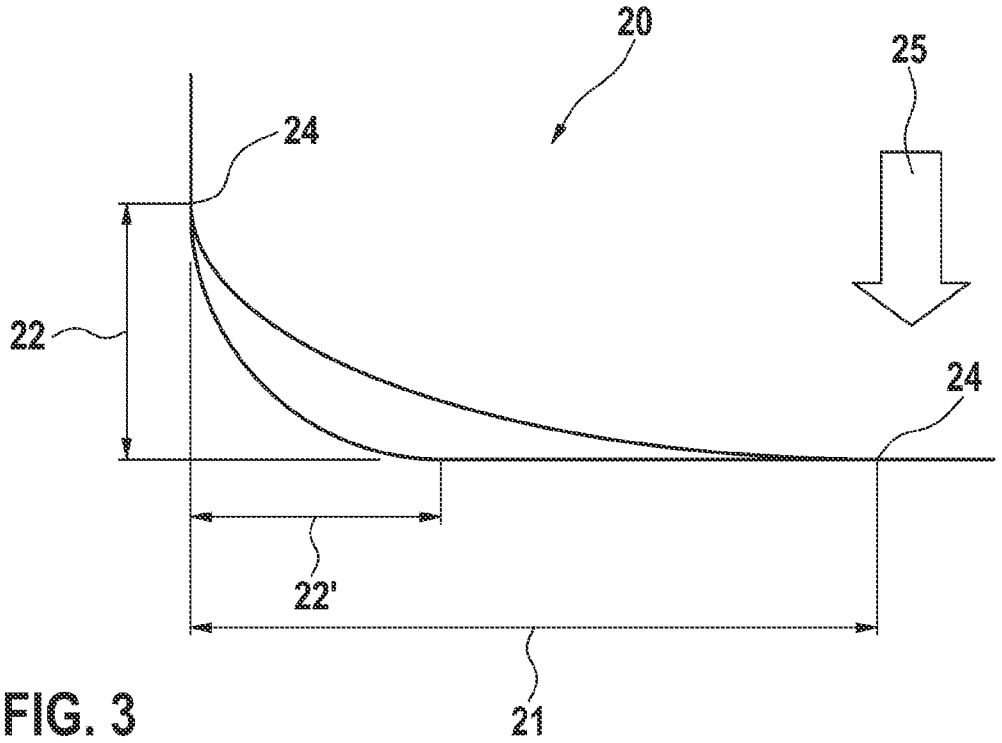
FIG. 3 shows a first view of a fillet of the spark plug according to an example embodiment of the present invention.
Figure 4:
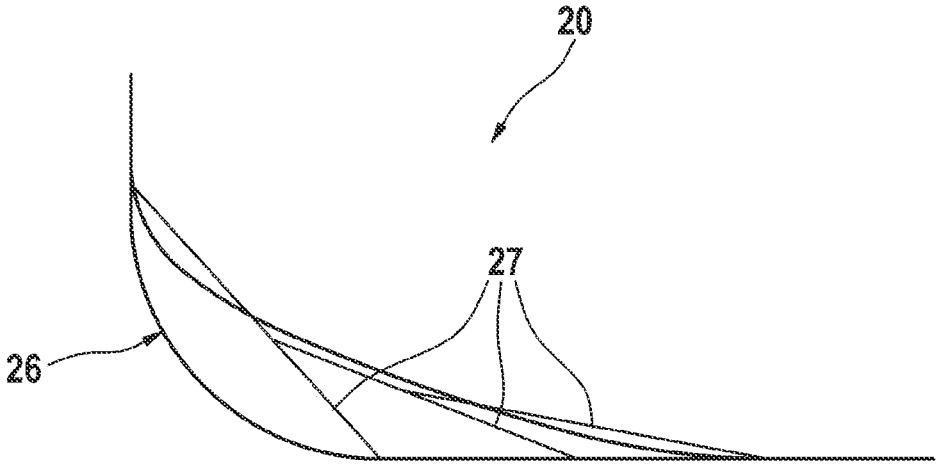
FIG. 4 shows a second view of the fillet of the spark plug according to an example embodiment of the present invention.

FIGS. 3 and 4 show the geometry of fillets 20 in detail. A cross section of fillet 20 is apparent in both figures.

FIG. 3 shows that fillet 20 transitions into a straight line at each of its two ends. The transition points from fillet 20 into the straight lines are provided with reference numeral 24. Between both transition points 24, a first leg length 21 and a second leg length 22 are each measured in parallel to a straight line. In an approximately circular fillet, as occurs in the related art, both leg lengths are of equal length, corresponding to both reference numerals 22 and 22'. According to the present invention, it is, however, provided that first leg length 21 is significantly longer than second leg length 22. First leg length 21 is defined according to force 25 acting on fillet 20. In particular, a tensile load occurs in spark plug 1 in the direction of center axis 8, so that first leg length 21 is defined perpendicularly to center axis 8 at corresponding fillets 20.

FIG. 4 also shows fillet 20 viewed in cross section. The final contour of fillet 20 as well as the ratio of both leg lengths 21, 22 are established with the aid of three straight lines 27. For comparison, FIG. 4 shows the curve of a conventional fillet 26 having two legs of equal length.

In addition to the transitions having fillets 20 shown in the detail, fillet 20 according to the present invention can also be used at all cross section transitions of spark plug 1.

What is claimed is:

1. A spark plug comprising:

a housing;

an insulator inside the housing;

a center electrode inside the insulator; and a connecting pin inside the insulator;

wherein a respective fillet, which, when viewed in cross section parallel to a central longitudinal axis of the spark plug, includes a first leg and a second leg at an angle to the first leg and shorter than the first leg, is formed at each of at least one change between cross sections of at least one of the housing, the insulator, the center electrode, and the connecting pin, the cross sections being perpendicular to the central longitudinal axis, wherein the fillet, when viewed in cross section parallel to the central longitudinal axis of the spark plug, has a continuously curved shape that forms a first transition to a first straight line and forms a second transition to a second straight line, wherein a length of the first leg is measured parallel to the first straight line, and wherein a length of the second leg is measured parallel to the second straight line, so that the continuous curved shape transitions to the first straight line over a distance larger than a distance over which the continuous curved shape transitions to the second straight line.

2. The spark plug of claim 1, wherein the first leg is at least 1.5 times as long as the second leg.

3. The spark plug of claim 1, wherein the first leg is at least twice as long as the second leg.

4. The spark plug of claim 1, wherein the spark plug is arranged such that the first leg is situated perpendicularly to a greatest force acting on the fillet.

5. The spark plug of claim 1, wherein:

the connecting pin includes a pin shaft and a collar;

the collar rests on the insulator; and one of the at least one fillet is formed at a transition from the collar to the pin shaft.

6. The spark plug of claim 1, wherein the housing includes (a) a thread by which the housing can be screwed into a combustion for screwing in the housing and (b) a shaft, one of the at least one fillet is formed at a transition from the shaft to the thread.

7. The spark plug of claim 1, wherein:

the housing includes the shaft, a shrink groove, and a polygon; and the at least one fillet includes a respective fillet at least one of a transition from the shaft to the shrink groove and a transition from the polygon to the shrink groove.

8. The spark plug of claim 1, wherein the center electrode includes a seat at one of the changes between cross sections at which one of the at least one fillet is formed, the seat resting on the insulator.

9. The spark plug of claim 1, wherein the insulator includes a seat at one of the changes between cross sections at which one of the at least one fillet is formed, the seat resting on the housing.

10. The spark plug of claim 1, wherein the insulator includes a housing seat at one of the changes between cross sections at which one of the at least one fillet is formed, a side of the housing facing away from the combustion chamber resting on the housing seat.

11. The spark plug of claim 1, wherein the two legs are defined by respective transition points at which the fillet transitions into a straight line.

12. The spark plug of claim 1, wherein the first leg is at least 1.3 times as long as the second leg.

* * * * *